US006168053B1

(12) United States Patent
Keough

(10) Patent No.: US 6,168,053 B1
(45) Date of Patent: Jan. 2, 2001

(54) POSITIONING APPARATUS AND METHOD FOR PRECISION POURING OF A LIQUID FROM A VESSEL

(75) Inventor: Graham A. Keough, Hainesport Township, NJ (US)

(73) Assignee: Consarc Corporation, Rancocas, NJ (US)

( * ) Notice: Under 35 U.S.C. 154(b), the term of this patent shall be extended for 0 days.

(21) Appl. No.: 09/337,058

(22) Filed: Jun. 21, 1999

(51) Int. Cl.[7] ..... B22D 37/00
(52) U.S. Cl. ..... 222/590; 222/591; 222/598
(58) Field of Search ..... 222/1, 590, 591, 222/598

(56) References Cited

U.S. PATENT DOCUMENTS

| | | | |
|---|---|---|---|
| 2,892,225 | 6/1959 | Bührer et al. | 22/82 |
| 3,856,183 | 12/1974 | Bauer | 222/70 |
| 4,823,263 | 4/1989 | Thomas et al. | 364/559 |
| 5,186,845 * | 2/1993 | Detalle | 222/598 |
| 5,249,717 * | 10/1993 | Inubushi et al. | 222/598 |
| 5,381,855 | 1/1995 | Mezger | 164/457 |
| 5,690,854 * | 11/1997 | Bruckner et al. | 222/598 |
| 5,792,378 | 8/1998 | Christensen et al. | 222/590 |

* cited by examiner

*Primary Examiner*—Scott Kastler
(74) *Attorney, Agent, or Firm*—Seidel, Gonda, Lavorgna & Monaco, PC.

(57) ABSTRACT

Apparatus and method accomplishes the precision pouring of a liquid from a vessel to a predetermined position with a controlled rate of flow. Independently controllable horizontal and vertical translation of the vessel is accomplished by using two rotational elements lying in substantially parallel planes, with the rotational axis of the second element passing through the first element, and having offset first and second axes of rotation. Independently controlled tilting of the vessel about a third axis of rotation that passes through the second element maintains a desired pour rate and aim point for the pour stream. The apparatus is particularly useful when the vessel and the receptacle that receives the liquid are inside a sealed chamber.

29 Claims, 7 Drawing Sheets

POSITIONING APPARATUS AND METHOD FOR PRECISION POURING OF A LIQUID FROM A VESSEL

FIELD OF THE INVENTION

The present invention relates to precision pouring of a liquid from a vessel into a container, particularly when the vessel and container are located inside a chamber.

BACKGROUND OF THE INVENTION

In vacuum metallurgy and in many other fields, liquids, such as molten metals and alloys, are often processed inside a chamber containing an atmosphere that may be at, above or below ambient atmospheric pressure. Such processing includes the pouring of a liquid at a pre-determined rate from a vessel, such as a melting furnace, into a container such as a mold. A vessel generally having a pour lip and containing a liquid is tilted to establish a pour stream that is targeted at an opening in the container. The desired pour rate may be fixed, or it may be profiled, meaning that the desired rate varies during the course of the pour. Since the targeted opening is usually fixed and the trajectory of the pour stream changes during the pour, the relative positions of the vessel and container must be controllable to allow the pre-determined flow rate and aim point to be maintained. Where the container is not moved, the horizontal (or X-axis) position of the vessel and its tilt angle measured from the Y-axis (orthogonal to the X-axis) must be adjustable. If it is also desired to simultaneously control the vertical distance of the pour lip above the target opening, the vertical position of the vessel must also be controlled.

A known approach to meeting the above requirements is to mount the vessel on a manipulator, located inside the chamber. However, such a manipulator is difficult to access for maintenance or repair. Moreover, any mechanism so located is likely to be exposed to liquid splash, fume, condensation of volatiles evolved from the liquid, etc., so it is likely to need frequent maintenance or repair. Therefore, it is advantageous that essentially all of the mechanism for moving and tilting the vessel be accessibly located outside of the chamber and sealed such that it is not exposed to the atmosphere inside. The seal system must also maintain the integrity of the atmosphere, allowing gases to leak neither out of nor into the chamber.

A prior art approach that achieves some of the above objectives is to mount the vessel eccentrically on a plate which is supported from the chamber wall and which rotates about the center of a circular peripheral seal. Rotary motion about said center is advantageous because sealing surfaces that were covered by the seal, and therefore protected from contamination prior to such rotation, remain covered and protected during and after rotation. Such protection from contamination such as splash, fume and condensates improves seal life. Rotation about this first axis, which is at a relatively large vertical distance below the vessel pour lip, will move the pour lip primarily in the horizontal direction, as long as the amount of angular motion is kept small. Rotation about a second axis, located closer to the vessel's pour lip than the first axis, tilts the vessel to assist the pouring of molten metal from the vessel.

This approach, however, has its own disadvantages. The requirement that the amount of angular motion about the first axis be kept small, means that for a given amount of traverse motion, a relatively large distance must be maintained between the pour lip and the first axis of rotation. This requirement makes the rotary plate relatively large in diameter. Consequently, relatively large forces are exerted on it when there is a significant differential pressure between the outside and the inside of the chamber. In such a case, which happens commonly, the plate must be built to withstand these large forces. This can make the plate relatively heavy and expensive. These large forces also undesirably increase the loads on the bearings that rotatably connect the plate to the chamber, unless additional compensating measures are taken. Another disadvantage of this approach is that, since the vessel's translation movement is an arc, there will also be some accompanying, coupled vertical movement of the vessel as the plate is rotated to obtain the required horizontal translation. Therefore, the height above the target opening of the vessel and its pour lip change as a function of the translation motion. This height change, being a function of the geometry of the apparatus and the motion around the two axes, is not independently controllable. For precision pouring, it is desirable that the pour lip height be independently controllable.

In the present invention, a combination of rotational movements about two offset axes can be used to achieve a truly horizontal translation of a vessel if such is desired, while a coordinated rotational movement about a third axis can be used to control the tilt angle of the vessel. This combination has the capability of pouring at a controlled rate, while simultaneously directing the pour stream at an aim point. This apparatus can be made more compact than the prior art apparatus just described, while providing equivalent or better functionality. Such compactness minimizes the above disadvantageous aspects of the prior art, while also permitting installation of the present invention on smaller chambers.

Alternatively, the rotations about the three axes may be differently coordinated, to further provide an independently controllable vertical component to the motion of the vessel. In this case, not only can the pour rate be maintained at a pre-selected value and the pour stream directed at the aim point as described above, but the vertical position of the pour lip can also be independently controlled.

SUMMARY OF THE INVENTION

The present invention, in one aspect, is a method for pouring liquid from a vessel by a fluid stream that flows from the vessel to a predetermined location or aim point. Three rotational elements are established to provide for two-dimensional movement of the vessel simultaneously with independent controllable tilt of the vessel. The first element rotates about a first axis of rotation. The second element rotates about a second axis of rotation. Relative to the first element, the rotational axis of the second element is located within the periphery of the first element, with its axis of rotation offset from and substantially parallel to the axis of rotation for the first element. The third element rotates about a third axis of rotation. Relative to the second element, the rotational axis of the third element is located within the periphery of the second element, with its axis of rotation substantially parallel to and offset from the axis of the second element. The vessel is connected to the third element. Consequently, rotation of the first, second and third elements about the first, second and third axes of rotation, respectively, will translate and rotate the vessel to accomplish pouring of the liquid from the vessel by a fluid stream to a predetermined location. If the offset distance between the axes of rotation for the first and second elements and the offset distance between the axes of rotation for the second and third elements are equal, then equal counter-rotation of the first and second elements will translate the vessel a horizontal distance of up to four times the equal offset distance. With equal offset distances and without equal counter-rotation, the trajectory of the two dimensional translation can be anywhere within a circle centered on the axis of rotation for the first element, and having a diameter equal to four times the equal offset distance.

In another aspect, the present invention is apparatus for pouring a liquid from a vessel by using a positioning system that has three rotatable elements. The first element has an opening and is connected to a fixed supporting structure in such manner that it is rotatable about an axis of rotation relative to the fixed supporting structure. The second element has an opening and is connected to the first element in such manner that it is rotatable about a second axis of rotation relative to the first element. The second element is located in a substantially parallel plane relative to the first element, and the second axis of rotation passes through the opening in the first element. The axis of rotation for the second element is offset from and substantially parallel to the axis of rotation for the first element. The third element is connected to the second element in such manner that it is rotatable about a third axis of rotation relative to the second element. The third element is located in a substantially parallel plane relative to the second element, and the third axis of rotation passes through the opening in the second element. The axis of rotation for the third element is offset from and substantially parallel to the axis of rotation for the second element. A supporting structure for the vessel projects from the third element, through the openings in the first and second elements, so that rotation of the third element rotates the vessel. This rotation allows the vessel tilt angle to change and results in fluid flow from the vessel that is independently controlled. Rotation of first and second elements will translate the vessel in a two-dimensional plane parallel to the planar orientation of the first, second and third elements. If the offset distance between the axes of rotation for the first and second elements, and the offset distance between the axes of rotation for the second and third elements are equal, then equal counter-rotation of the first and second elements will translate the vessel a horizontal distance of up to four times the equal offset distance. With equal offset distances and without equal counter-rotation, the trajectory of the two dimensional translation can be any where within a circle centered on the axis of rotation for the first element, and having a diameter equal to four times the equal offset distance.

In still another aspect, the present invention is apparatus and a method for the precision pouring of a liquid from a vessel that provides for motion of the vessel in a two-dimensional plane and an independently controllable tilt motion of the vessel. The precision pouring is accomplished by using a positioning system that has three rotatable elements. A wall has a first opening. The first element is disposed in a plane substantially parallel with said wall and occupies the first opening. The first element is rotatable about a first axis of rotation. The first axis of rotation is perpendicular to the said plane substantially parallel with the wall and passes through said first opening. The first element has a second opening. The second element is disposed in a plane substantially parallel with the wall and occupies the second opening. The second element is rotatable relative to the first element about a second axis of rotation. The second axis of rotation is parallel to and offset from the first axis of rotation, and passes through the first and second openings. The second element has a third opening. The third rotatable element is a structure adapted to support a liquid-containing vessel. The structure occupies the third opening and projects axially away from the wall. The vessel-supporting structure is rotatable relative to the second element about a third axis of rotation. The third axis of rotation is parallel to and offset from the second axis of rotation, and passes through the first, second, and third openings. A liquid-containing vessel is so supported by the vessel-supporting structure that liquid can be poured from the vessel by rotation about the third axis. The first and second elements are rotated about the first and second axes of rotation so as to position said vessel at a desired position.

The vessel-supporting structure is rotated about the third axis of rotation so as to pour liquid from the vessel. The rotation about the third axis allows the vessel tilt angle to change and results in fluid flow from the vessel that is independently controlled. Rotation of the first and second elements will translate the vessel in a two-dimensional plane parallel to the planar orientation of the first, second and third elements. If the offset distance between the axes of rotation for the first and second elements is equal to the offset distance between the axes of rotation for the second and third elements, then equal counter-rotation of the first and second elements will translate the vessel a horizontal distance of up to four times the equal offset distance. With equal offset distances and without equal counter-rotation, the trajectory of the two dimensional translation can be anywhere within a circle centered on the axis of rotation for the first element, and having a diameter equal to four times the equal offset distance. The means for rotatably connecting the first, second and third elements to the wall, first element and second element, respectively, can be ball bearing assemblies. The sealing of the first, second and third elements to the wall, first element and second element, respectively, can be accomplished using circular dynamic seals, such as O-rings. Additionally, drives can be provided to achieve the rotation of the first, second and third elements. With appropriate power and control, the drives can be used to provide manual or automatic bi-directional rotation of first, second and third elements.

A reading of the following description and appended claims will provide a thorough understanding of the invention.

DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 5(*b*) is an enlarged cross sectional detail of the bearing and seals arrangement for first, second and third elements used with the positioning apparatus of the present invention.

FIG. 5(*c*) is an enlarged cross sectional detail of the bearing and seals arrangement for the vessel mounting structure used with the positioning apparatus of the present invention.

DETAILED DESCRIPTION OF THE INVENTION

Figure 1:
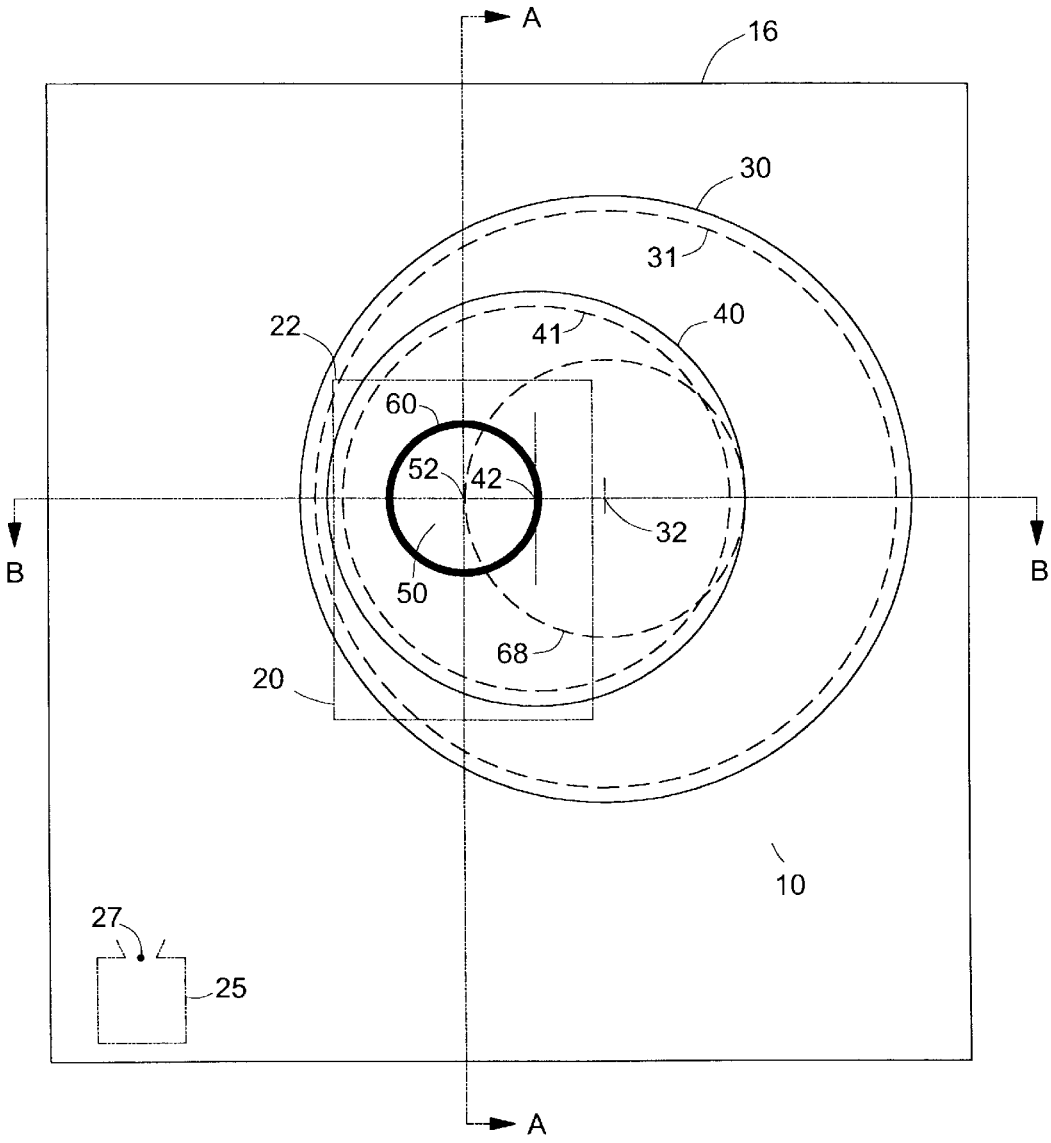
FIG. 1 is an elevational view of the positioning apparatus of the present invention for pouring a liquid from a vessel, looking at the apparatus from outside a chamber, and showing the rotatable elements of the apparatus in one particular orientation.
Figure 2:
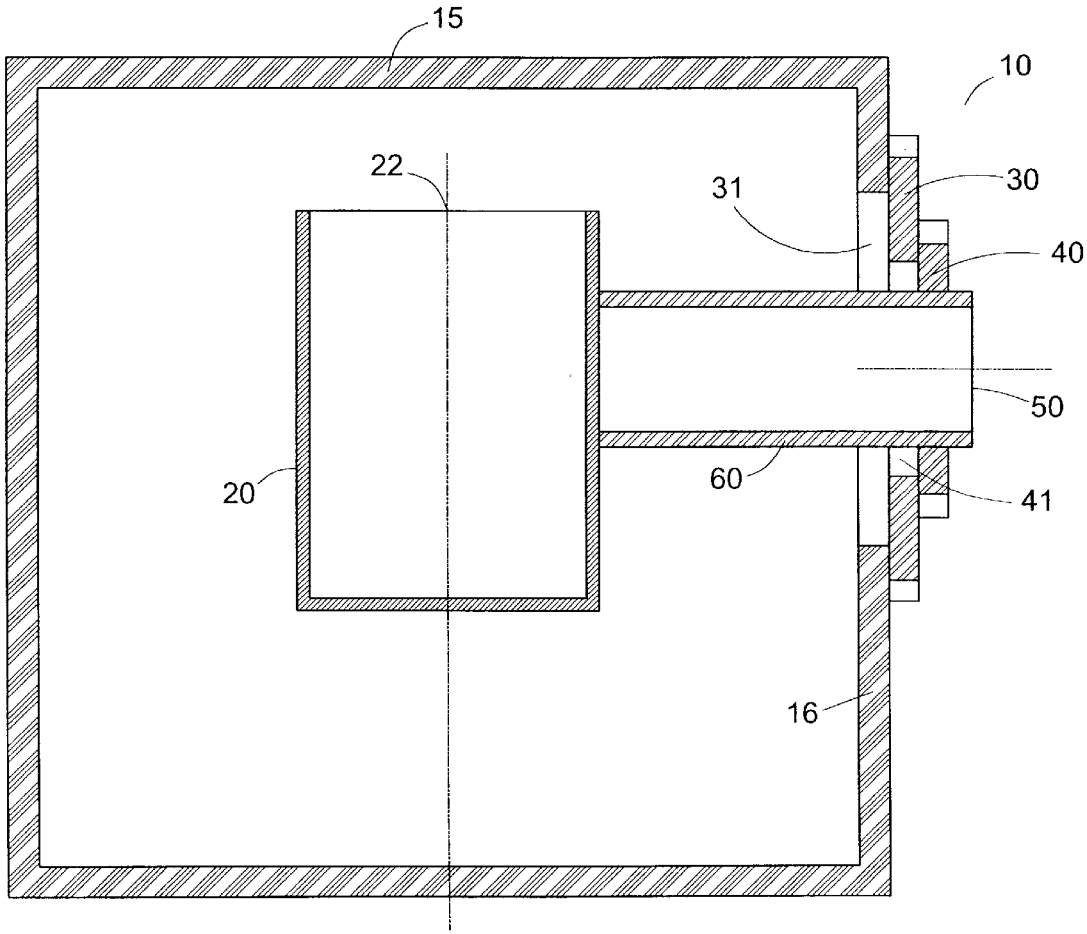
FIG. 2 is a cross sectional side view of the apparatus of FIG. 1, as indicated by section line AA in FIG. 1.
Figure 3:
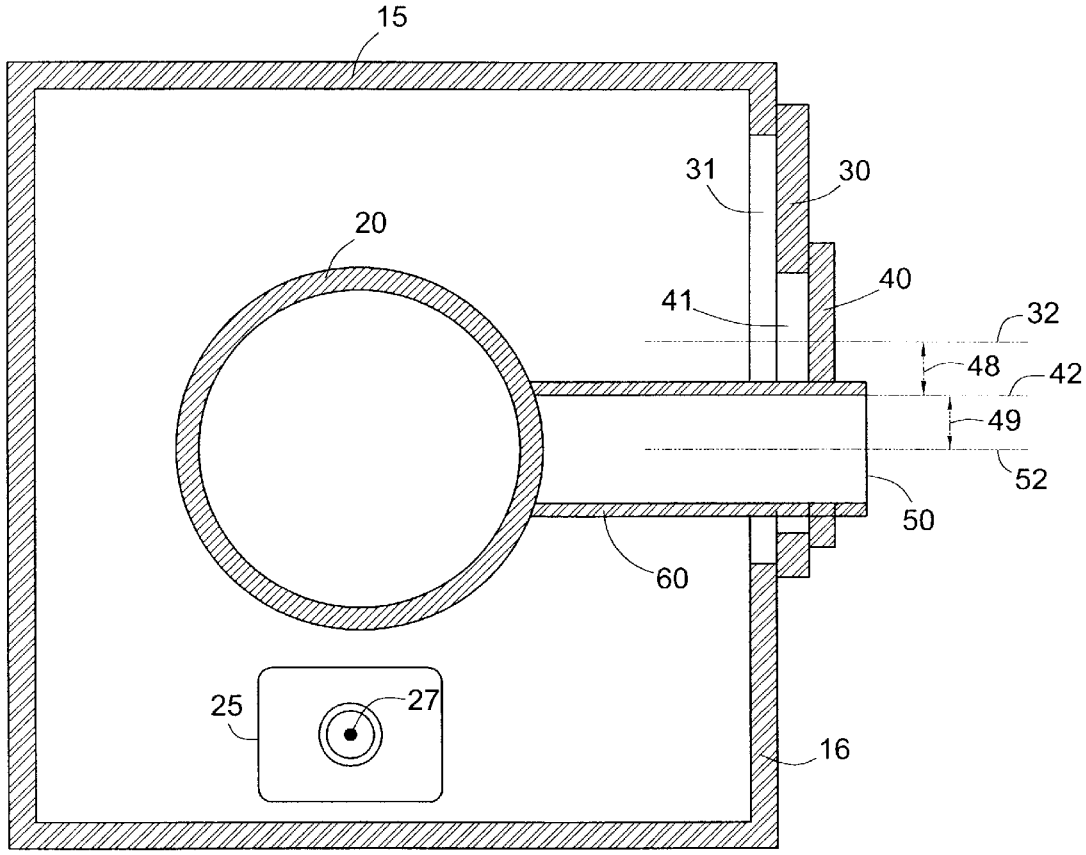
FIG. 3 is a cross sectional planar view of the apparatus of FIG. 1, as indicated by section line BB in FIG. 1.
Figure 4A:
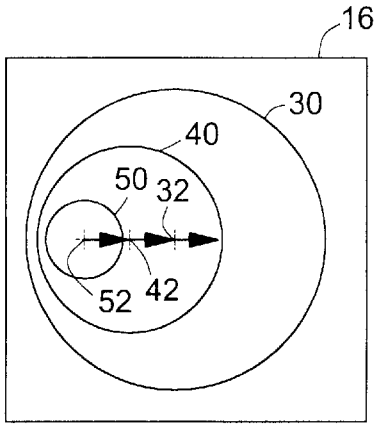
FIGS. 4(*a*), 4(*b*), 4(*c*), 4(*d*) and 4(*e*) schematically illustrates the full range of horizontal translation of a vessel using the positioning apparatus of the present invention.
Figure 4B:
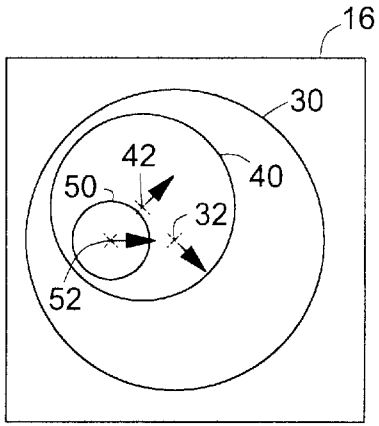
Figure 4C:
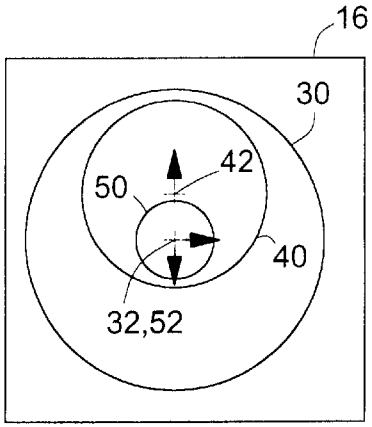
Figure 4D:
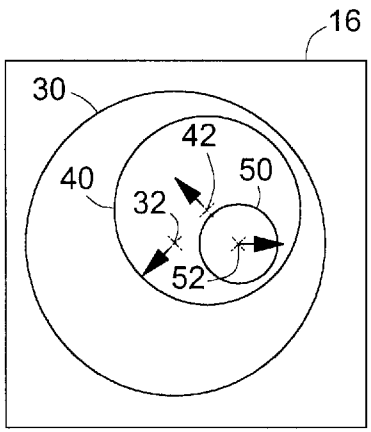
Figure 4E:
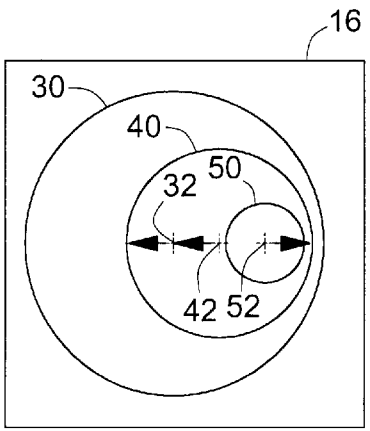

Referring now to the drawings, wherein like numerals indicate like elements, there is shown in FIGS. 1 through 3, in accordance with the present invention, a positioning apparatus 10 mounted on the wall 16 of a chamber 15 for pouring a liquid from a vessel 20 into a container 25 with a target or aim point 27 for the liquid stream, the vessel, container and pour stream all being inside the chamber. FIG. 1. is a view of the positioning apparatus 10 from outside the chamber. Consequently, container 25 and vessel 20 are shown in phantom in FIG. 1. In the figures, chamber 15 is shown as an enclosed box for convenience of depicting one type of chamber that could be used, rather than limiting the configuration of the chamber. Container 25 can be any type of receptacle having an opening for receiving the fluid stream. For example, the receptacle may be a mold, with aim point 27 being the center of the mold's pour cup. It should be appreciated that the aim point 27 generally represents the center of a fluid stream since the stream will pass through a defined area, rather than a point. Vessel 20 generally has a pour lip 22 over which the fluid flows when the vessel is tilted. The pour lip can also be a spout or other element that provides a flow path for molten metal out of the vessel when the vessel is tilted. Vessel 20 may be a furnace, ladle, or other apparatus known in the art of processing molten or other liquid materials.

First element 30 is disposed to cover an opening 31 in the wall 16 of chamber 15. First element 30, rotatable about a first axis of rotation 32, is mounted on wall 16 and is peripherally sealed to the wall by a circular, substantially gas-tight dynamic seal such as an elastomeric O-ring, which is substantially concentric with the first axis of rotation 32. As shown in the figures, first element 30 has an opening 41 to allow for the passage of vessel mounting structure 60 through first element 30. For clarity, rotational means, bearings and seals for first element 30 are not shown in FIGS. 1 through 3. Second element 40 is rotatably attached and similarly peripherally sealed to first element 30, covering the opening 41 in first element 30. Second element 40 is rotatable about a second axis of rotation 42, which is substantially parallel to first axis of rotation 32. As shown in the figures, second element 40 has an opening to allow for the passage of vessel mounting structure 60 through second element 40. For clarity, rotational means, bearings and seals for second circular element 40 are not shown in FIGS. 1 through 3. As shown in FIG. 3, axes of rotation 32 and 42 are separated by a first offset distance 48. Without limitation, first and second elements 30 and 40, respectively, may be circular metal plates, with appropriate openings, supported by peripherally located roller, plain or other bearings.

Vessel mounting structure 60, as shown in FIGS. 1 through 3, is a hollow tube in the shape of a circular cylinder. The first open base of the cylindrical mounting structure 60 defines a third element 50, as shown in the figures. The end of the cylindrical mounting structure 60 opposite the first open base provides a point of connection to vessel 20. For the purpose of allowing the vessel to be controllably tilted, mounting structure 60 is rotatably disposed in an opening in the second circular plate 40 and peripherally sealed to it. Third element 50 is rotatable about a third axis of rotation 52, which is substantially parallel to second axis of rotation 42. As shown in FIG. 3, axes of rotation 52 and 42 are separated by second offset distance 49. Preferably, first and second offset distances 48 and 49 are substantially equal.

While the vessel mounting structure 60 is shown in the drawings as a hollow circular cylinder, other configurations are also satisfactory as long as the structure is used to mount vessel 20 so that the vessel can be rotated about the third axis of rotation 52 located as described above. Consequently, rotation of the mounting structure 60 about the third axis of rotation 52 will also result in corresponding rotation of the connected vessel 20. As shown in FIGS. 1 through 3, vessel 20 is in the zero degree tilt position (angle of vertical centerline of the vessel from the vertical Y-axis). An artisan will appreciate that intervening support and mounting structural elements may be incorporated between mounting structure 60 and vessel 20. A hollow cylinder is not a necessity, but if the vessel 20 is a furnace which requires cables and tubing to supply electrical power and cooling water, the bore of a hollow cylinder provides a convenient path for routing such cables and tubing.

While the bearings, seals and rotational components for first and second elements, 30 and 40, and for vessel mounting structure 60, can be made in many ways, particular components are described below.

In the preferred arrangement, in which first and second offset distances 48 and 49 are equal (equal offset distance), rotation of first element 30 and second element 40 through equal angles in opposite directions about their respective axes of rotation 32 and 42, will result in a horizontal translation of the vessel as shown in FIGS. 4(*a*) through 4(*e*). During this translation, a simultaneous coordinated rotation of vessel mounting structure 60 about the third axis of rotation 52 permits the vessel to be positioned at any desired vessel tilt angle for any horizontal position. When first and second elements 30 and 40 have rotated 180 angular degrees, as shown in FIG. 4(*e*), from the position shown in FIG. 4(*a*), vessel 20, attached to mounting structure 60 will have translated horizontally by a distance equal to four times the equal offset distance, without accompanying vertical motion. The horizontal translation of first and second elements 30 and 40, and appropriate coordinated rotation of vessel mounting structure 60, can be used to establish a selected pour profile of liquid over the pour lip so that the liquid stream has a desired rate of flow and its center is continually directed to the predetermined aim point 27. In comparison with the prior art approach of using a comparatively large element with restricted arc movement to accomplish mainly horizontal motion of the vessel, the present invention provides for an equivalent range of horizontal movement in less space.

For other pour processes using the preferred arrangement, coordinated varying rotation of first and second elements 30 and 40, not limited to equal angular counter-rotations, can be used to move the third axis of rotation 52 along a trajectory that lies anywhere within a circle 68 shown in phantom in FIG. 1. Circle 68 is concentric with first element 30 and has a diameter equal to four times the equal offset distance. Selection of a trajectory having appropriate vertical, horizontal and vessel tilt components can provide uncoupled, independent control of not only the pour rate and fluid stream aiming, but also the height of the vessel's lip above the aim point. The availability of independent vertical, horizontal and tilting motions can also be useful for other purposes, such as positioning the vessel for filling or maintenance.

In FIGS. 4(*a*) through 4(*e*), the reference arrow on each of the rotating components of the system, first, second and third elements, 30, 40 and 50 (and the vessel 20 and mounting structure 60 by connection to third element 50) is used to indicate angular position of the rotating components, as they move through their complete range of horizontal motion. As indicated by the arrow on mounting structure 60, the vessel remains at zero tilt angle throughout this sequence, though it should be appreciated that, at any horizontal location, third element 50 and connected mounting structure 60, may be rotated to tilt the connected vessel, and to thereby obtain a liquid pour stream with a desired flow rate.

Summarizing the general configuration of the first, second and third elements, first element 30 is peripherally connected to a fixed supporting structure, which can be the wall 16 of a chamber 15. The peripheral connection between the first element 30 and the fixed supporting structure is such that the first element 30 can be rotated about its axis of rotation 32. Second element 40 is peripherally connected to the first element 30 in a manner such that the second element 40 can rotate about its axis of rotation 42. The second axis of rotation 40 is located within the periphery of the first element 30. The third axis of rotation 50 is locate within the periphery of the second element 40. In general terms, vessel supporting structure 60 is a structure projecting from the perimeter of the third element 50. The supporting structure passes through openings in the first and second elements. It will be appreciated that environmental seals will not be required between interfacing elements when the positioning system 10 is not used in a sealed chamber. Furthermore, while the preferred embodiment uses peripheral means for connecting the elements to each other, and to the wall of the chamber, other methods of connection are suitable for the present invention.

Figure 5A:
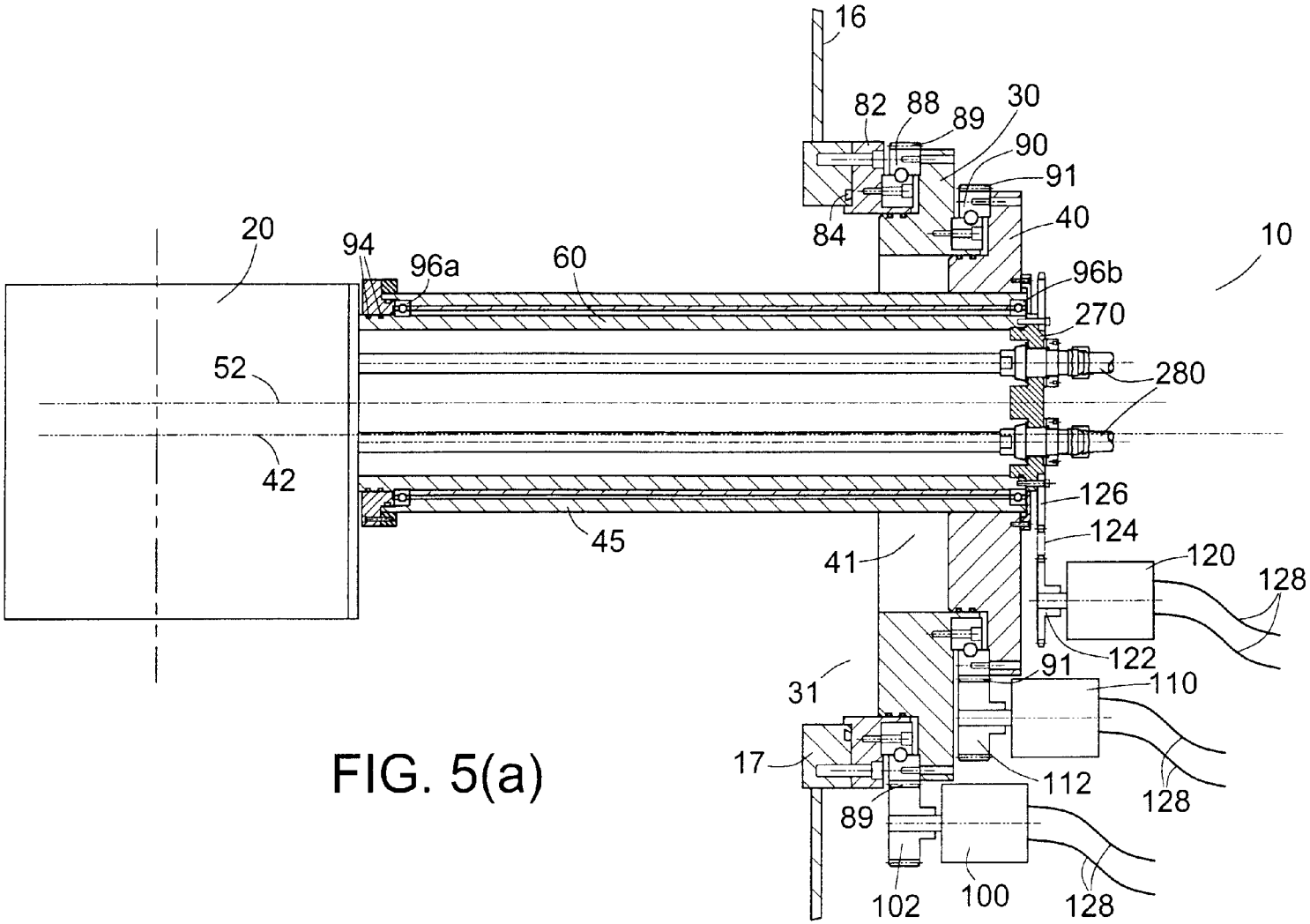
FIG. 5(*a*) is a cross sectional side view showing bearings, seals and rotation means used in one arrangement of the present invention.
Figure 5B:
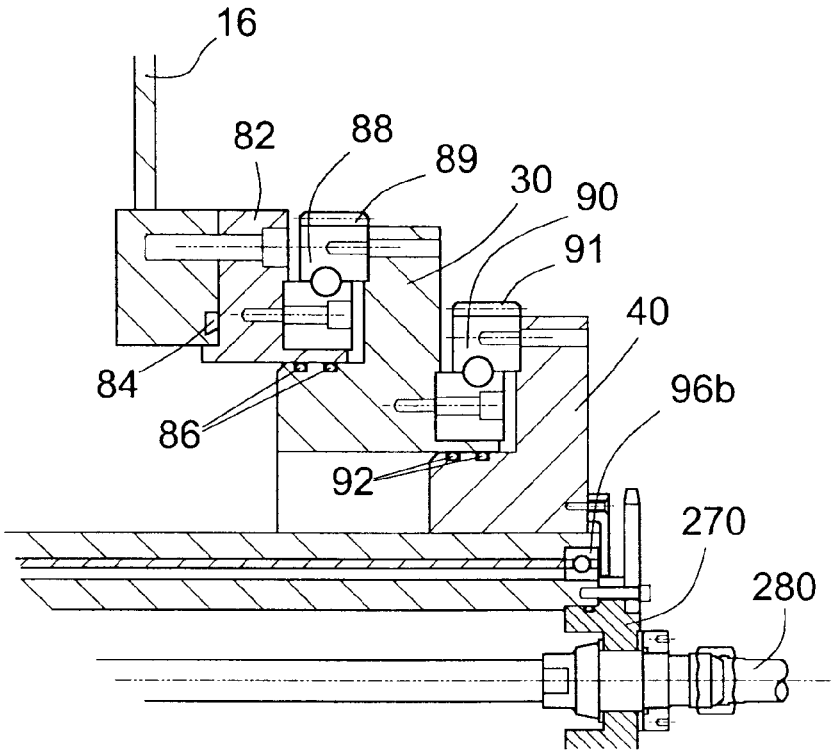
Figure 5C:
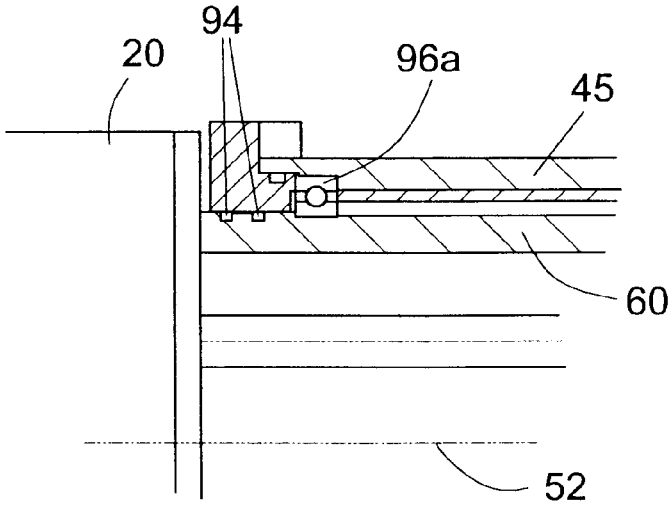

FIG. 5(*a*) shows in cross sectional view one preferred arrangement of the bearings, seals and drive means of the present invention. In order to display these components most clearly, first element 30 has been rotated 90 degrees clockwise from the position shown in FIGS. 1 through 3. In addition, vessel mounting structure 60 has been rotated 90 degrees counter clockwise, to keep the vessel at zero tilt angle. FIG. 5(*a*) thereby illustrates the vessel at maximum translation in the upwards, or Y direction. The chamber has a circular opening in its wall 16 that is bounded by a chamber structural supporting ring 17. Chamber structural supporting ring 17 is integrally connected to the wall of the chamber. Adapter ring 82 is connected to chamber structural supporting ring 17. The interface for the adapter ring and chamber structural supporting ring is environmentally sealed by static O-ring 84. It should be appreciated that in alternate embodiments of the invention, the chamber structural supporting ring 17 and adapter ring 82 can be integral with the wall 16 of the chamber. Adapter ring 82 supports first peripheral ball bearing assembly 88, which provides the rotational support for first element 30. First element 30 is connected to and supported by ball bearing assembly 88 as shown in FIG. 5(*a*). O-ring seals 86, are located concentric with ball bearing assembly 88 in adjacent grooves in first element 30 as shown in detail in FIG. 5(*b*). One or more O-rings can be provided. The preferred embodiment with two O-ring seals 86 is shown in the figures. The space between the two O-rings is preferably filled with an oil or grease to provide lubrication for these O-rings, which dynamically seal first element 30 to the adjacent surface of adapter ring 82. Ball bearing assembly 88 has radially-oriented gear teeth 89 disposed around its outer periphery. First pinion gear 102, driven by first hydraulic motor 100, engages teeth 89. Motor 100 is attached by conventional mounting means not shown in the drawings to the wall 16 of the chamber 15. This arrangement allows motor 100 to rotate first element 30 relative to wall 16.

In like manner first element 30 supports ball bearing assembly 90, which provides the rotational means for second element 40. Second element 40 is connected to and supported by ball bearing assembly 90 as best shown in FIG. 5(*b*). O-ring seals 92 are located concentric with ball bearing assembly 90 in adjacent groves in second element 40 as shown in detail in FIG. 5(*b*). One or more O-rings can be provided. The preferred embodiment with two O-ring seals 92 is shown in the figures. The space between the two O-rings is preferably filled with an oil or grease to provide lubrication for these O-rings, which dynamically seal second element 40 to the adjacent surface of first element 30. Ball bearing assembly 90 has radially-oriented gear teeth 91 disposed around its outer periphery. Second pinion gear 112, driven by second hydraulic motor 110, engages teeth 91. Motor 110 is attached by conventional mounting means not shown in the drawings to first element 30. This arrangement allows motor 110 to rotate second element 40 relative to first element 30.

In the embodiment of the invention shown in FIG. 5(*a*), vessel mounting structure 60 is supported from a tubular extension 45 of second element 40 by dual co-axial ball bearing assemblies 96*a* and 96*b*. Dynamic sealing of vessel mounting structure 60 to second element 40 is by dual lubricated O-ring seals 94 between the tubular extension 45 of second element 40 and the vessel supporting structure as best shown in FIG. 5(*c*). One or more O-ring seals can be provided. In this embodiment, third element 50 is defined as the first open base of the cylindrical vessel mounting structure 60 adjacent to ball bearing assembly 96(*b*). Rotation of vessel mounting structure 60 relative to second element 40 is performed by a sprocket drive. Third hydraulic motor 120 has first sprocket 122 attached to its output shaft. Second sprocket 126 is radially attached to the exterior of the first base of vessel mounting structure 60. The links of chain 124 are engaged by sprockets 122 and 126 to rotate vessel mounting structure 60. Motor 120 is attached by conventional mounting means not shown in the drawings to second element 40.

While elastomeric O-rings are used in the preferred embodiment, any type of circular dynamic seals would be suitable for the application. Although hydraulic drives are shown in the drawings for rotation of first and second elements 30 and 40, and vessel mounting structure 60, an artisan will appreciate that other drives, such as electrical or pneumatic, with appropriate power source, can be used to accomplished powered rotation of these components.

As shown in the embodiment in FIG. 5(*a*), first and second elements 30 and 40 are circular plates with openings and fastener means for connection to components in the positioning system 10. Circular packing elements 270 provide closure for the open base of the vessel mounting structure and transit openings for cables 280 that transport electrical power and cooling water to vessel 20. For a hydraulic-driven power system, hydraulic fluid supply and return lines 128 connect motors 100, 110 and 120 to a hydraulic power and control system further described below.

Figure 6:
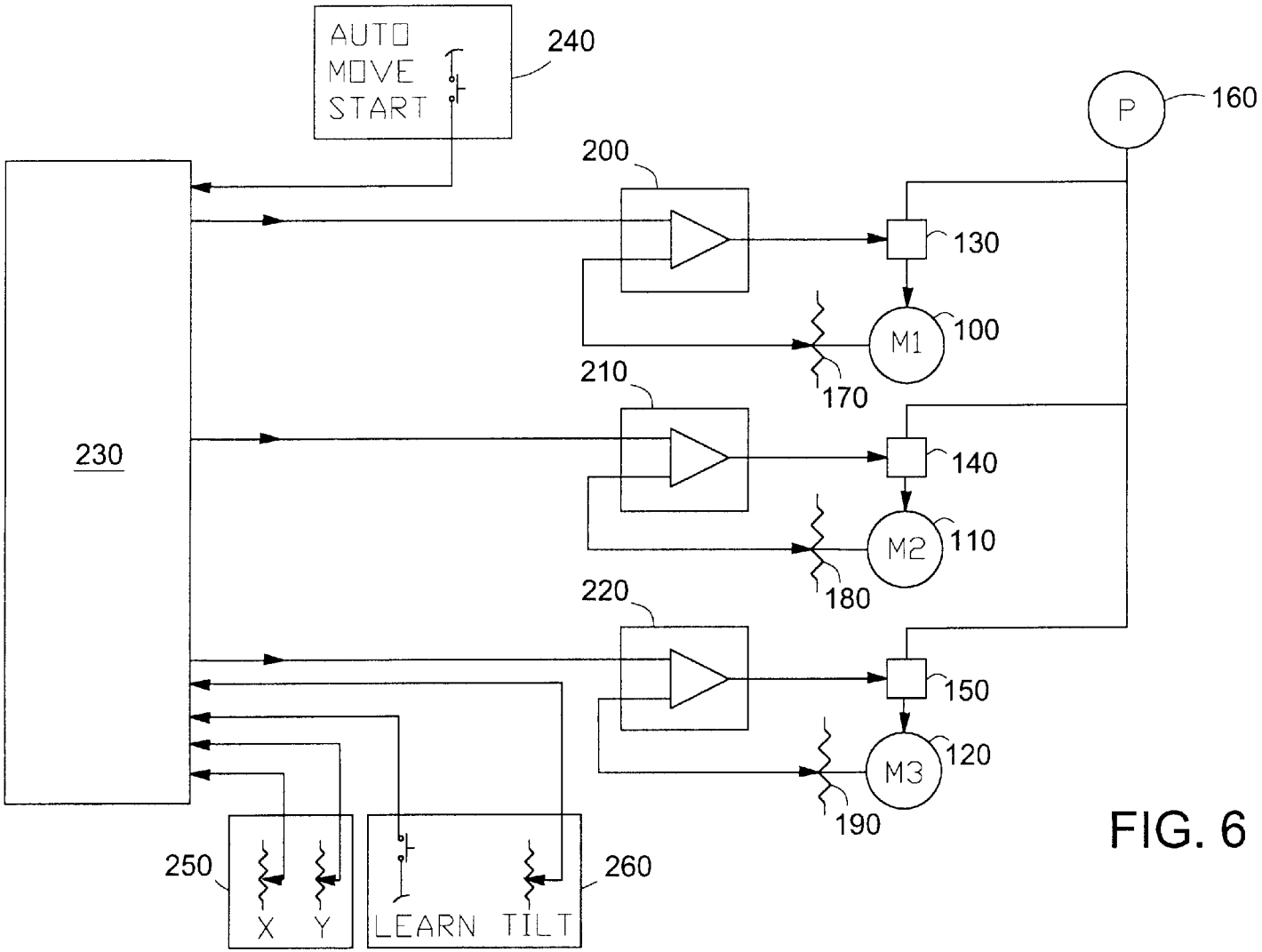
FIG. 6 is a schematic diagram showing a preferred control system used with the positioning apparatus of the present invention.

A preferred method for controlling the rotational positions of the first and second elements 30 and 40 and vessel mounting structure 60 of the present invention is shown schematically in FIG. 6. Hydraulic fluid from a pressurized source 160, such as a hydraulic pump, flows to first hydraulic motor 100, which is bidirectional, via first four-way hydraulic valve 130. The flow of hydraulic fluid through valve 130 is controlled by the output signal from first position error amplifier 200. This error amplifier, in turn, receives a position command signal from a system controller 230, and a position feedback signal from first potentiometer 170, which indicates the angular position of first element 30 relative to the wall 16 of chamber 15. The wiper arm of potentiometer 170 is connected to first element 30 and the potentiometer's resistive element is attached to the wall of chamber in suitable fashion so that angular rotation of first element 30 will result in a change of the potentiometer's resistance that will be proportional to the degree of angular rotation of first element 30. Error amplifier 200 is designed such that any difference between the desired position of first element 30, represented by a command signal from system controller 230, and the actual angular position of first element 30, represented by the signal from potentiometer 170, causes an output signal to be produced. This signal causes valve 130 to open such that the resulting flow of oil from pressurized source 160 to motor 100 causes motor 100 to rotate. Motor 100, mounted on chamber 15 and having an output shaft that is rotationally coupled to first element 30, causes first element 30 and the wiper of potentiometer 170 to rotate in a direction which reduces the above difference. When the difference reaches zero, indicating that first element 30 has reached the commanded position, valve 130 closes and motor 100 stops. First element 30 is therefore continuously driven by this hydraulic position control loop to the angular position commanded by system controller 230. For best control, valve 130 is preferably a servo or proportioning type valve in which the opening of the valve is proportional to the signal received from position error amplifier 200. System controller 230 preferably comprises a digital storage and computing device, capable of storing a series of values for the desired position of first element 30 and outputting these as command signals in a timed sequence during a pour or other vessel motion.

In like manner, the rotational position of second element 40 relative to first element 30, as indicated by second potentiometer 180, is controlled at a second angular position commanded by system controller 230 by a second hydraulic position control loop that includes second four-way hydraulic valve 140, second position error amplifier 210 and second (bidirectional) hydraulic motor 110. Also in like manner, the rotational position of vessel mounting structure 60 relative to second element 40, as indicated by third potentiometer 190, is controlled at a third angular position commanded by system controller 230 by a third hydraulic position control loop that includes third four-way hydraulic valve 150, third position error amplifier 220 and third (bidirectional) hydraulic motor 120.

It will be appreciated by an artisan that the potentiometers used in the preferred embodiment are one type of angular position transducer sensors known in the art. Other position sensors are readily adaptable to the present invention. For non-hydraulic drives, the four-way hydraulic valves 130, 140 and 150 will be understood to be drive controllers for controlling the speed and direction of the position outputs of the appropriate rotational means that replace the hydraulic motors 100, 110, and 120.

System controller 230 is preferably a digital computer, programmable logic controller or 3-axis digital motion controller. Error amplifiers 200, 210 and 220 may advantageously be of the Proportional Integral Derivative (PID) type well known to those skilled in the closed-loop-position-control art. Commercially available digital motion controllers often include such amplifiers, implemented partially in software. For reasons that are detailed later, system controller 230 is preferably also programmed with an algorithm that converts any desired position of the vessel, expressed in the form of X and Y coordinates, or components in another coordinate system, plus the vessel's tilt angle relative to the wall 16 of chamber 15, into the corresponding rotational angles of first, second and third elements, 30, 40 and 50 (and vessel mounting structure 60 by connection to element 50). Such an algorithm can be derived from a simple geometric analysis of the system. Preferably, system controller 230 continuously maintains master position values for the desired X and Y coordinates of the vessel, together with its tilt angle. The algorithm described above converts these values to corresponding rotational position commands for the three hydraulic positioning loops, as previously described.

During any automated vessel movement, system controller 230 converts a stored sequence of X, Y and tilt angle positions into a corresponding series of rotational position commands for the three hydraulic position control loops. If the vessel motion is for an automated pour, this causes rotational motion about the three axes such that the pour rate of the fluid from the vessel follows a desired flow rate profile, the position of the terminal end of the pour stream is maintained at the aim point 27 and, optionally, the vertical position of the pour lip of the vessel relative to the aim point is also controlled.

One way to generate the required list of master positions is by a process in which a skilled operator makes a manually controlled vessel movement and the system controller 230 records the resulting master positions at frequent intervals as the vessel motion proceeds. For this purpose, as well as for general re-positioning of the vessel under operator control, the preferred control system includes joysticks 250 and 260. Other types of input devices are also suitable. Joystick 250 has a spring-centered handle movable in two directions, X and Y. The displacement of joystick 250 in each direction produces a proportional output signal on a corresponding potentiometer. Signals from these potentiometers are read by system controller 230 as representing a desired velocity of vessel 20 in the corresponding X and Y directions. For ease of control, joystick 250 is preferably mounted such that movement of the joystick handle in a particular direction results in vessel motion in the same direction, be it X, Y or any combination of the two. Joystick 260 is similar to 250 but has a single potentiometer representing the desired tilt velocity.

Operation of the system in the manual control mode is as follows. Manual displacement of any joystick handle away from its spring-centered position causes system controller 230 to increment or decrement the corresponding master position value, i.e., X-position, Y-position, tilt angle or any combination of these three values. The rate at which each of the master values is changed is made proportional to the corresponding joystick handle displacement. At frequent intervals, the newly calculated master position values are converted to position values for each of the three hydraulic positioning loops by the algorithm previously mentioned, and outputted as position commands. The hydraulic servo positioning loops cause the vessel 20 to move as directed by system controller 230. New loop position commands are preferably generated by system controller 230 sufficiently frequently that the resulting vessel motion takes place smoothly.

By depressing a pushbutton that can be integrated with joystick 260, as shown in FIG. 6, any manually controlled movement operation may be recorded. Such pushbutton activation causes the ensuing sequence of master position commands to be stored by system controller 230 as a profile that may be re-called and re-played at any later time. System controller 230 is preferably able to store a number of such profiles. Prior to activating such a pre-recorded movement, the operator would indicate to system controller 230, by means of a keyboard or other input device not shown in FIG. 6, which of the pre-stored motion profiles is to be used. The corresponding vessel motion would thereafter commence upon a command, such as activation of pushbutton 240. Such a prerecorded vessel motion may be used to perform a pour operation, or to achieve any other vessel re-positioning that may be repetitively required during the course of operation or maintenance.

As an alternative to recording a manually controlled sequence as described above, the list of master vessel positions required for a motion profile may also be obtained by pre-calculation from the geometry and dynamics of the system. Such calculations may be performed by system controller 230, or by another computing device, the resulting sequence of master vessel positions being communicated to system controller 230.

Summarizing one embodiment of the process, a pour profile, comprising a manually or automatically generated motion profile resulting from rotational movements of the first and second elements 30 and 40, either separately or coordinately, and a manually or automatically generated rotation of the third element 50, with attached vessel 20 and supporting structure 60, can be executed to pour liquid from the vessel to a predetermined location or aim point 27.

The pouring apparatus and process disclosed in the present invention is particularly applicable to technologies using chambers that operate under internal vacuum or internal positive pressure. It may also be used for applications that use a controlled atmosphere at ambient atmospheric pressure. Furthermore, two synchronously driven sets of the mechanical parts of the apparatus disclosed in the present invention, can be located on opposite sides of a large vessel to provide two-sided support for such a vessel.

The foregoing embodiments do not limit the scope of the disclosed invention. The scope of the disclosed invention is covered in the appended claims.

What is claimed is:

1. A method for pouring a liquid from a vessel by a fluid stream that flows from the vessel to a pre-selected location, comprising the following steps:

establishing a first element with a first axis of rotation;

establishing a second element with a second axis of rotation, said second axis of rotation positioned substantially parallel to the first axis of rotation, and offset from said first axis of rotation by a first offset distance, said second axis of rotation disposed within the periphery of the first element;

establishing a third element with a third axis of rotation, said third axis of rotation positioned substantially parallel to the first and second axes of rotation, and offset from said second axis of rotation by a second offset distance, said third axis of rotation disposed within the periphery of the second element;

supporting the vessel containing the liquid from said third element; and rotating said first, second and third elements about the first, second and third axes of rotation, respectively, to pour the liquid from said vessel by a fluid stream to the pre-selected location.

2. The method of claim 1 wherein said first and second offset distances are equal.

3. The method of claim 2 further comprising rotating said first and second elements coordinately about the first and second axes of rotation, respectively, to translate the third axis of rotation in a horizontal path through a distance of up to four offset distances.

4. The method of claim 2 further comprising rotating said first and second elements coordinately about the first and second axes of rotation, respectively, to translate the third axis of rotation within a circle centered on said first axis of rotation about the first axis of rotation, the circle having a radius equal to the sum of said first and said second offset distances.

5. Apparatus for precision pouring of a liquid from a vessel comprising:

first element rotatably connected to a fixed supporting structure, said first element having an opening and being rotatable about a first axis of rotation;

second element rotatably connected to said first element, said second element disposed in a plane substantially parallel with the first element, the second element having an opening and being rotatable about a second axis of rotation, said second axis of rotation passing through the opening in the first element and being offset from the first axis of rotation by a first offset distance;

third element rotatably connected to said second element, said third element disposed in a plane substantially parallel with the second element, the third element being rotatable about a third axis of rotation, said third axis of rotation passing through the opening in the second element and being offset from the second axis of rotation by a second offset distance; and vessel supporting structure rotatably connected to said third element, the vessel supporting structure spatially projecting from the periphery of the third element, through the openings in said first and second elements, the vessel connected to said vessel supporting structure whereby rotation about the first, second and third axes of rotation rotates and positions said vessel to pour liquid from the vessel to a pre-selected location.

6. The apparatus of claim 5 wherein said first and second offset distances are equal.

7. The apparatus of claim 6, wherein said first element and said second element are coordinately rotatable about the first and second axes of rotation, respectively, whereby the third axis of rotation is translatable in a horizontal path through a distance of up to four offset distances.

8. The apparatus of claim 6, wherein said first element and said second element are coordinately rotatable about the first and second axes of rotation, respectively, whereby the third axis of rotation is translatable within a circle centered on said first axis of rotation about the first axis of rotation, the circle having a radius equal to the sum of said first and said second offset distances.

9. Apparatus for precision pouring of a liquid from a vessel to a pre-selected point, comprising:

a wall having a first opening;

a first element disposed in a plane substantially parallel with said wall and occupying said first opening, said first element having a second opening, said first element being rotatable about a first axis of rotation, said first axis of rotation being perpendicular to said plane substantially parallel with said wall and passing through said first opening;

a second element disposed in a plane substantially parallel with said wall and occupying said second opening, said second element having a third opening, said second element being rotatable relative to said first element about a second axis of rotation, said second axis of rotation being parallel to and offset from the first axis of rotation, and passing through said first and second openings; and a vessel-supporting structure adapted to support a liquid-containing vessel, said structure occupying said third opening and projecting axially away from the wall, said structure being rotatable relative to said second element about a third axis of rotation, said third axis of rotation being parallel to and offset from the second axis of rotation, and said third axis of rotation passing through said first, second, and third openings;

whereby selected rotation of said first and second elements and said vessel-supporting structure about the first, second and third axes of rotation positions and rotates said vessel.

10. Apparatus according to claim 9, wherein said second axis of rotation is offset from the first axis of rotation by a first offset distance, and said third axis of rotation is offset from the second axis of rotation by a second offset distance substantially equal to the first offset distance.

11. Apparatus according to claim 9, wherein said vessel-supporting structure closes said third opening, said second member and said vessel-supporting structure close said second opening, and said first and second members and said vessel-supporting structure close said first opening.

12. Apparatus according to claim 9, wherein each of said first, second, and third openings is generally circular and is centered on said first, second, and third axis, respectively, and each of said first and second elements is generally circular and is centered on said first and second axis, respectively, and a part of said vessel-supporting structure occupying said third opening is generally circular and is centered on said third axis.

13. Apparatus according to claim 9, wherein said vessel-supporting structure is located within a sealed chamber, and said wall is a wall of said sealed chamber.

14. Apparatus according to claim 9, wherein said first element is sealed to said wall, said second element is sealed to said first element, and said vessel-supporting structure is sealed to said second element, so as to remain sealed as said elements rotate.

15. Apparatus according to claim 14, wherein the first and second elements and said vessel-supporting structure are sealed to the wall of the chamber, first element and second element, respectively, by circular dynamic seals.

16. Apparatus according to claim 9, wherein said first and second elements and said vessel-supporting structure are rotatably connected to the wall of the chamber, first element and second element, respectively, by ball bearing assemblies.

17. Apparatus according to claim 9, further comprising:

a first motor attached to the wall, with its output engaging the first element to rotate said first element;

a second motor attached to the first element, with its output engaging the second element to rotate said second element; and a third motor attached to the second element, with its output engaging the vessel-supporting structure to rotate the vessel-supporting structure.

18. Apparatus according to claim 17, further comprising:

a power source;

first, second and third drive controllers connected to said power source and the first, second and third motors, respectively, to control the speed and direction of the position outputs of said motors;

a first angular position transducer attached to the wall and driven by the first element whereby the angular position of said first element is indicated by the output of said first angular position transducer;

a second angular position transducer attached to the first element and driven by the second element whereby the angular position of said second element is indicated by the output of said second angular position transducer;

a third angular position transducer attached to the second element and driven by said vessel-supporting structure whereby the angular position of said vessel-supporting structure is indicated by the output of said third angular position transducer;

a system controller;

a first error amplifier having first input from said system controller, second input from the first angular position transducer, and one output to said first drive controller to control the output to said first motor;

a second error amplifier having first input from said system controller, second input from the second angular position transducer, and one output to said second drive controller to control the output to said second motor;

a third error amplifier having first input from said system controller, second input from the third angular position transducer, and one output to said third drive controller to control the output to said third motor; and input devices to the system controller to manually rotate said first and second elements and said vessel-supporting structure or store pour profiles in said system controller.

19. A method for precision pouring of a liquid from a vessel to a pre-selected point, comprising:

providing a wall having a first opening;

providing a first element disposed in a plane substantially parallel with said wall and occupying said first opening, said first element having a second opening, said first element being rotatable about a first axis of rotation, said first axis of rotation passing through said first opening and being perpendicular to said plane substantially parallel with said wall;

providing a second element disposed in a plane substantially parallel with said wall and occupying said second opening, said second element being rotatable relative to said first element about a second axis of rotation, said second axis of rotation being parallel to and offset from the first axis of rotation, and passing through said first and second openings;

providing a vessel-supporting structure adapted to support a liquid-containing vessel, said structure occupying said third opening, said structure being rotatable relative to said second element about a third axis of rotation, said third axis of rotation being parallel to and offset from the second axis of rotation, and said third axis of rotation passing through said first, second, and third openings;

providing a liquid-containing vessel so supported by said vessel-supporting structure that liquid can be poured from said vessel by rotation about said third axis;

rotating said first and second elements about the first and second axes of rotation so as to position said vessel at a desired position; and rotating said vessel-supporting structure about the third axis of rotation so as to pour liquid from the vessel.

20. A method according to claim 19, wherein said second axis of rotation is offset from the first axis of rotation by a first offset distance, and said third axis of rotation is offset from the second axis of rotation by a second offset distance equal to the first offset distance.

21. A method according to claim 20, further comprising rotating said first and second elements coordinately about the first and second axes of rotation, respectively, to translate the third axis of rotation in a horizontal path through a distance of up to four offset distances.

22. A method according to claim 20, further comprising rotating said first and second elements coordinately about the first and second axes of rotation, respectively, to translate the third axis of rotation within a circle centered on said first axis of rotation about the first axis of rotation, the circle having a radius equal to the sum of said first and said second offset distances.

23. A method according to claim 19, wherein said vessel-supporting structure closes said third opening, said second member and said vessel-supporting structure close said second opening, and said first and second members and said vessel-supporting structure close said first opening.

24. A method according to claim 19, wherein each of said first, second, and third openings is generally circular and is centered on said first, second, and third axis, respectively, and each of said first and second elements is generally circular and is centered on said first and second axis, respectively, and a part of said vessel-supporting structure occupying said third opening is generally circular and is centered on said third axis.

25. A method according to claim 19, which comprises providing said vessel-supporting structure within a sealed chamber, wherein said wall is a wall of said sealed chamber.

26. A method according to claim 19, wherein said first element is sealed to said wall, said second element is sealed to said first element, and said vessel-supporting structure is sealed to said second element, so as to remain sealed as said elements rotate.

27. A method according to claim 19, further comprising:

rotating said first element by way of a first motor attached to the wall, with its output engaging the first element;

rotating said second element by way of a second motor attached to the first element, with its output engaging the second element; and rotating said vessel-supporting structure by way of a third motor attached to the second element, with its output engaging said vessel-supporting structure.

28. A method according to claim 27, further comprising:

providing a power source;

controlling the speed and direction of the position outputs of said first, second and third motors by way of first, second and third drive controllers connected to said power source and to the first, second and third motors, respectively;

indicating the angular position of said first element by the output of a first angular position transducer attached to the wall and driven by the first element;

indicating the angular position of said second element by the output of a second angular position transducer attached to the first element and driven by the second element;

indicating the angular position of said vessel-supporting structure by the output of a third angular position transducer attached to the second element and driven by said vessel-supporting structure;

comparing an input from a system controller with the output of the first angular position transducer in a first error amplifier and producing one output to said first drive controller to control the output to said first motor;

comparing an input from said system controller with the output of from the second angular position transducer in a second error amplifier and producing one output to said second drive controller to control the output to said second motor; and comparing an input from said system controller with the output of the third angular position transducer in a third error amplifier and producing one output to said third drive controller to control the output to said third motor.

29. A method according to claim 28, comprising inputting to the system controller to manually rotate said first and second elements and said vessel-supporting structure or to store pour profiles in said system controller.

* * * * *

UNITED STATES PATENT AND TRADEMARK OFFICE

CERTIFICATE OF CORRECTION

PATENT NO. : 6,168,053 B1

DATED : January 2, 2001

INVENTOR(S) : Keough

It is certified that error appears in the above-identified patent and that said Letters Patent is hereby corrected as shown below:

In the specification, col. 7, line 22, "of rotation 40 " should read -- of rotation 42 --.

In the specification, col. 7, line 23, "of rotation 50" should read -- of rotation 52 --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*